US010684047B2

(12) United States Patent
Khatri et al.

(10) Patent No.: US 10,684,047 B2
(45) Date of Patent: Jun. 16, 2020

(54) SYSTEM FOR CRYOGENIC COOLING OF REMOTE COOLING TARGET

(71) Applicants: Ajay Khatri, Bethlehem, PA (US); Terence Rufer, Oley, PA (US)

(72) Inventors: Ajay Khatri, Bethlehem, PA (US); Terence Rufer, Oley, PA (US)

( * ) Notice: Subject to any disclaimer, the term of this patent is extended or adjusted under 35 U.S.C. 154(b) by 0 days.

(21) Appl. No.: 15/093,929

(22) Filed: Apr. 8, 2016

(65) Prior Publication Data

US 2016/0298888 A1 Oct. 13, 2016

Related U.S. Application Data

(60) Provisional application No. 62/144,687, filed on Apr. 8, 2015.

(51) Int. Cl.
*F25B 9/02* (2006.01)
*A61B 18/02* (2006.01)
(Continued)

(52) U.S. Cl.
CPC ..... *F25B 41/003* (2013.01); *F25B 9/02* (2013.01); *F25B 19/005* (2013.01)

(58) Field of Classification Search
CPC . A61B 18/02; A61B 18/0212; A61B 18/0218; A61B 18/0231; A61B 18/0237; A61B 18/0243; A61B 18/025; A61B 18/0256; A61B 18/0262; A61B 18/0268; A61B 18/0293; F25B 9/00; F25B 41/003; F25B 19/005; F25B 9/02; F25B 9/14; F25B 9/10

See application file for complete search history.

(56) References Cited

U.S. PATENT DOCUMENTS 3,188,822 A 6/1965 Daunt
3,423,955 A 1/1969 Wright
(Continued)

FOREIGN PATENT DOCUMENTS

WO PCT/US2001/40849 A1 3/2002

*Primary Examiner* — Frantz F Jules
*Assistant Examiner* — Erik Mendoza-Wilkenfel
(74) *Attorney, Agent, or Firm* — Caesar Rivise, PC

(57) ABSTRACT

A system for cryogenic cooling of a remote cooling target comprising a cryogenic cooling device and a flexible cold fluid discharge interface, said flexible cold fluid discharge interface further comprising a flexible outer hose, a flexible middle recirculation line, a flexible inner hose, a flexible cryogen supply line, a first annular vacuum insulating area disposed between said flexible outer hose and said middle recirculation line, and a second annular vacuum insulating area disposed between said flexible inner hose and said flexible supply line. Said outer flexible hose, first evacuated annular segment, recirculation line, inner hose, second evacuated annular segment and supply line are arranged substantially concentrically. The system further comprising a first connecting means for connecting a first terminal end of the flexible cold fluid discharge interface to said cryogenic cooling device and a second connecting means comprising a rigid insertion member disposed at the second terminal end of the flexible cold fluid discharge interface for inserting into a remote cooling location.

14 Claims, 4 Drawing Sheets

(51) Int. Cl.
*F25B 41/00* (2006.01)
*F25B 19/00* (2006.01)

(56) References Cited

U.S. PATENT DOCUMENTS

| | | | | |
|---|---|---|---|---|
| 4,766,741 | A | 8/1988 | Bartlett et al. | |
| 5,275,595 | A * | 1/1994 | Dobak, III | A61B 18/02 606/20 |
| 5,334,181 | A * | 8/1994 | Rubinsky | A61B 18/02 606/20 |
| 5,520,682 | A | 5/1996 | Baust et al. | |
| 6,070,414 | A | 6/2000 | Ross et al. | |
| 6,442,948 | B1 * | 9/2002 | Takeda | F17C 3/085 62/48.2 |
| 2002/0120258 | A1 * | 8/2002 | Lalonde | A61B 18/02 606/23 |
| 2009/0234345 | A1 * | 9/2009 | Hon | A61B 18/02 606/21 |
| 2011/0264084 | A1 * | 10/2011 | Reid | A61B 18/02 606/23 |
| 2012/0059364 | A1 * | 3/2012 | Baust | A61B 18/02 606/24 |
| 2013/0021032 | A1 * | 1/2013 | Heiss | F25B 9/02 324/316 |
| 2013/0047632 | A1 * | 2/2013 | Rillo Millan | F25B 9/00 62/6 |

* cited by examiner

SYSTEM FOR CRYOGENIC COOLING OF REMOTE COOLING TARGET

RELATED U.S. APPLICATION

The present application claims the benefit of provisional application 62/144,687.

FIELD OF THE INVENTION

The present invention relates generally to cryogenic systems and more particularly to a system for cryogenic cooling with a flexible interface for the transfer of cold from a cryocooling device to a remote point.

BACKGROUND

Cryocooling systems are employed to cool and transfer fluids, for example, in order to provide the very low temperatures needed for materials research. In such systems, a cryogenic device typically includes portions for lowering the temperature of a fluid to be supplied to the research point, and interface portions for transferring that cooled fluid from the cooling portion of the cryogenic system to the research point. These interface portions may additionally cool the supplied fluid through various methods.

The initial cooling portions of such systems are either open cycle or closed cycle systems. In an open cycle system, liquid cryogen (typically helium or nitrogen) is extracted from a liquid dewar using a liquid transfer line and injected in the cryogenic system to achieve the desired temperature at the sample under test. Cryogen is then exhausted into the atmosphere. This is expensive and logistically difficult, and does not allow long-term operation of the system since the liquid dewar needs to be replaced frequently. In this case however the sample can be remotely located from the liquid dewar and the discharge end of the transfer line inserted into the cryogenic system to provide cooling at the desired location of the sample.

In a closed cycle system, a cryocooler is employed to provide the desired low temperature at the cold stage of the cryocooler. An extension rod or similar setup is attached to the cold station to transfer cold to the cryogenic test sample, which is remote from the cryocooler. This approach has several drawbacks. First, it transmits vibrations from the cryocooler to the test sample. Second, heat load on the extension creates loss of cooling and increases the temperature of the extension rod at the end connected to the point of cooling. This approach also does not provide flexibility in locating the cryocooler, which is typically bulky and creates difficulty in positioning of the system. Such setups also require a large opening in the cryogenic system to insert the cryocooler cold end. These problems become severe when very low temperature liquid helium, such as 4.2 K or below, is desired at the sample.

It is known in the art to provide heat exchange between two or more fluids within the interface portion of a system. Systems of the prior art have typically achieved at least a portion of the cooling process through counter-flow (or parallel) heat exchange between the supply and return fluids of the system. Such systems frequently arrange the transfer lines for these supply and return fluids concentrically, either with the supply line inside or outside the return line, depending upon the relative need for each line to be insulated from ambient temperatures. In such a concentric line configuration, heat transfer, and therefore cooling of the supply fluid, involves convective heat transfer from the fluid that is to be cooled to the first wall of the tube or hose containing it, conductive heat transfer through the first tube wall of that tube to the second tube wall, and convective heat transfer from the second wall of the tube to the second fluid. This results in the desired effect of transferring heat from the first fluid to the second, thereby reducing the first fluid's temperature.

Prior art systems such as those described above rely on precision in the heat balance between the supply and return fluids, as well as selection of transfer line material. Further, the limitations inherent in such method of heat exchange limit the length of the interface over which the cooled fluid may be transferred while maintaining low and precise temperatures.

Therefore, a need remains for an improved thermal interface that permits less interaction between supply and return flows and the associated heat exchange that occurs due to the thermal contact between them, thereby increasing the length over which a cooled fluid may be transferred.

BRIEF SUMMARY OF THE INVENTION

The present invention is a system for cryogenic cooling of a remote cooling target having a flexible cold fluid discharge interface comprised of a flexible supply line disposed through substantially concentric annular portions. These annular portions are a flexible outer hose, a flexible middle hose and a flexible inner hose. The flexible supply line, for the purpose of delivering cold temperature from a cryogenic cooling device to a remote point, is disposed through the length of the flexible inner hose. The flexible middle hose, arranged substantially concentric to and outside of the flexible inner hose, is arranged to permit the return of the cold fluid from the remote point to the circuit of the cryogenic cooling device. The flexible outer hose, arranged substantially concentric to and outside of the flexible middle hose and flexible inner hose, functions to insulate the inner and middle hoses, and the flexible supply line, from ambient temperatures. Additionally, annular vacuum insulation segments, to further shield components of the flexible interface member of the device and fluid therein from radiant warming and to reduce heat exchange between fluids in the the inner and middle hoses, are disposed in the annular regions between each of: 1) the inner and middle hose; and 2) the middle and outer hose. Multi-layer insulation ("MLI") is disposed on the outer wall of the flexible supply line and on the outer wall of the flexible middle hose. The flexible cold fluid discharge interface member terminates with a rigid element, sometimes referred to as a cold tip or cold finger—referred to herein as a "Stinger®"—to be engaged with the remote cooling location, thereby permitting thermal connectivity of the flexible supply line to a remote cooling location for delivery of cold temperature. The terminal rigid Stinger portion of the flexible cold fluid discharge interface may be easily disengaged from one remote cooling location and the flexible cold fluid discharge interface re-positioned for engagement of the rigid Stinger to other remote cooling locations, providing the novel advantage of being capable of successively providing cold temperatures to multiple remote locations without requiring relocation of the cryogenic cooling device or the remote cooling points, and without requiring the system to the shut down and the system or its components to consequently be returned to substantially higher temperatures prior to engaging the flexible cold fluid discharge interface to a subsequent remote cooling target.

DETAILED DESCRIPTION AND PREFERRED EMBODIMENTS OF THE INVENTION

The invention of the present disclosure is described below with reference to certain embodiments. While these embodiments are set forth in order to provide a thorough and enabling description of the invention, these embodiments are not set forth with the intent to limit the scope of the disclosure. A person of skill in the art will understand that the invention may be practiced in numerous embodiments, of which those detailed here are merely examples. In order to allow for clarity of the disclosure of the claimed invention, structures and functions well known to those skilled in the art are not here disclosed. Those skilled in the art should also realize that equivalent systems do not depart from the spirit and scope of the invention in its broadest form.

Figure 1:
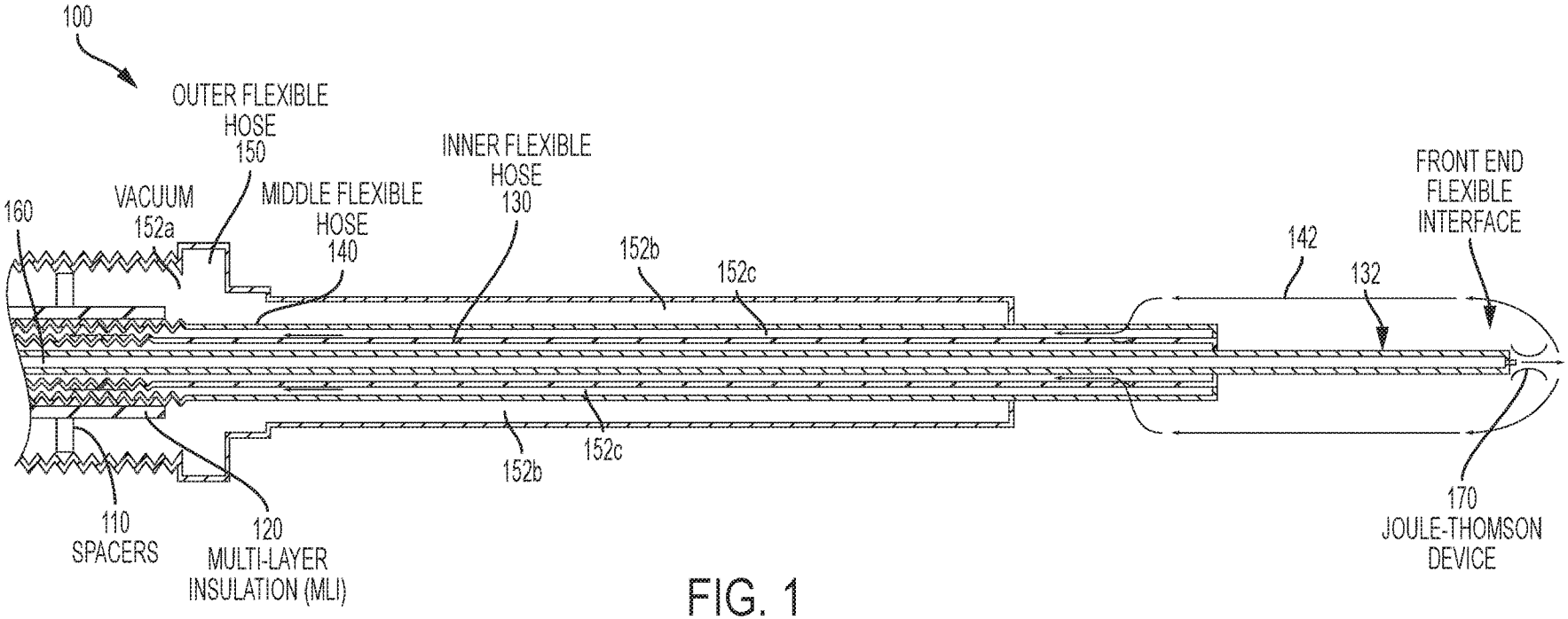
FIG. 1 is a cross-sectional view of the flexible cold fluid discharge interface member of the system.

FIG. 1 is a cross-sectional view of an exemplary embodiment of a flexible cold fluid discharge interface in accordance with the present disclosure. The flexible cold fluid discharge interface 100 is comprised of an inner flexible hose 130, a middle flexible hose 140 and an outer flexible hose 150. The inner flexible hose 130, middle flexible hose 140 and outer flexible hose 150 are arranged substantially concentrically to one another. Further comprising the flexible cold fluid discharge interface 100, disposed longitudinally through and substantially concentric with the inner flexible hose 130 is a flexible fluid supply line 160 for the delivery of cold temperatures to a remote location. By the arrangement of the hoses, a first annular area capable of evacuation 132 is created between the outer wall of the flexible supply line 160 and the inner wall of the inner flexible hose 130. A second annular area capable of evacuation 152 is created, by the arrangement of the hoses, between the outer wall of the middle flexible hose 140 and the inner wall of the outer flexible hose 150. In one exemplary embodiment, the first and second annular areas capable of evacuation 132, 152 are maintained by the placement of a plurality of rigid or semi-rigid spacers 110*a-n* within the first and second annular areas. Disposed on the outer wall of the flexible supply line 160 and on the outer wall of the middle flexible hose 140 is multi-layer insulating (MLI) material 120, such as, by way of non-limiting example aluminized Mylar®. This placement of the MLI 120 shields the cold fluid within the supply line 160 from radiant warming that would otherwise occur due to thermal contact and, therefore, heat exchange with the return flow 142 within the middle flexible hose 140. Similarly, the MLI 120 shields the return flow 142 within the flexible middle hose 140 from warming that would otherwise occur due to thermal contact with the radiation load of the flexible outer hose 150, including from the outer hose's contact with ambient warm air.

The flexible cold fluid discharge interface 100 may vary substantially in length. The first terminal end of the flexible cold fluid discharge interface 100 is capable of being connected to an output portion of a cold fluid supply mechanism such as a cryostat. In one exemplary embodiment, the second terminal end of the flexible supply line 160, coinciding with or proximate to the second terminal end of each of the hoses of the flexible cold fluid discharge interface 100, includes a thermal expansion device 170 such as a Joule-Thomson device, permitting expansion of the cold fluid transmitted by the flexible supply line 160, and therefore additional cooling of the fluid, as it is transferred from the area of high pressure within the flexible supply line 160 to an area of low pressure, this area, in the exemplary embodiment, being the remote cooling location.

The arrangement described with respect to FIG. 1 permits the transfer of cold fluid, through the flexible supply line 160 and a Joule-Thomson device 170, from a cooling mechanism to a remote cooling location, to which the flexible supply line 160 is connected by the rigid Stinger comprising the second terminal end of the flexible supply line. The arrangement described further permits the return of this fluid from the remote cooling location, through the flexible middle hose 140, to the cooling device or to another location. In the exemplary embodiment presented here and discussed in further detail with reference to FIG. 2, the return flow 142 is transmitted through the flexible middle hose 140 and returned to a cryostat to which the flexible cold fluid discharge interface 100 is connected by its first terminal end. During these transmissions of the supply and return flows, the fluid is insulated from ambient warming and warming due to heat exchange between the flows of the supply and return lines by the placement of the first and second annular evacuable areas 132, 152 and by the placement of MLI 120. Arrangements as in the preferred embodiment are capable of the delivery of cold fluid having a temperature of less than 4K, which very low temperature is advantageous in numerous contexts, such as materials research, and which temperatures are not achieved by configurations of the prior art.

Certain embodiments of the disclosed system provide further novel advantage by the connection of the aforementioned Joule-Thomson device 170, or alternate throttling mechanism, in a manner that permits interchangeability of the Joule-Thomson device. Whereas throttling mechanisms in systems of the prior art are typically welded, the configuration herein described permits a user of the system, a field technician or other person, without specialized skills, to remove and replace the Joule-Thomson device. This is desirable in various situations, such as where the Joule-Thomson device has become contaminated or where the use of a differently configured Joule-Thomson device more effectively permits compatibility with certain cold tips or other relevant system components. Replacement of the throttling device may also be desirable where the throttling device itself directly affects pressure optimization of the system.

Figure 2:
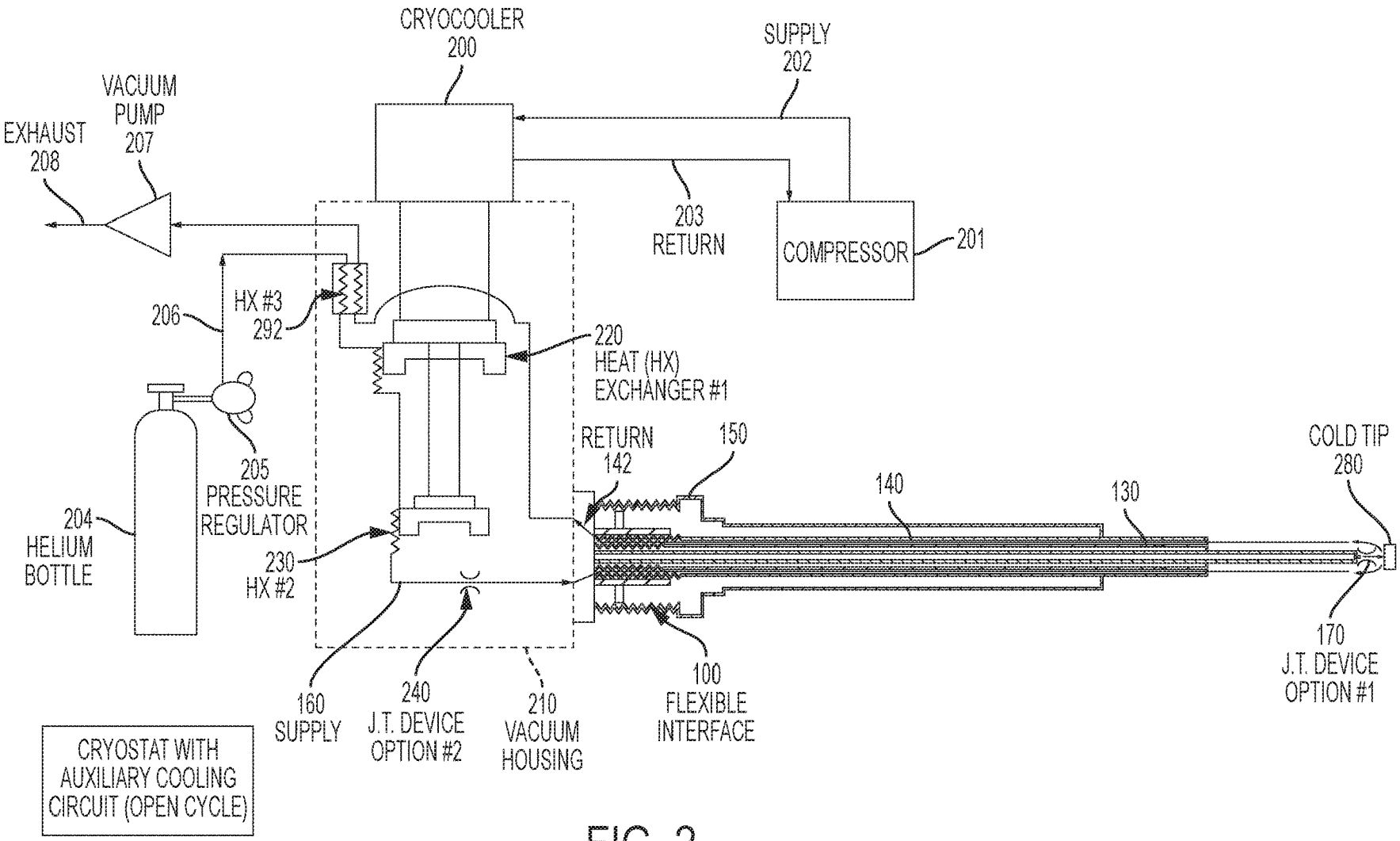
FIG. 2 is a block diagram showing the cryogenic cooling system with the flexible cold fluid discharge interface connected to a cryostat with an open-cycle auxiliary cooling circuit.

FIG. 2 is a block diagram representing an exemplary embodiment of a flexible interface 100 for the transfer of cold in accordance with the present invention connected to a cryostat with an open cycle auxiliary cooling circuit. The flexible interface 100 is comprised of a flexible supply line 160 for the transfer of cryogenic fluid, which may be a hose, tube, or other type of transfer line of one or more of various known materials; one such material being stainless steel. The flexible supply line 160 is disposed longitudinally through a flexible inner hose 130. Arranged substantially concentrically with and outside of the flexible inner hose 130 is a flexible middle hose 140, also for the transfer of cryogenic fluid, permitting the return flow 142 of the cryogenic fluid from the remote cooling point to the cryostat. Arranged substantially concentrically to and outside of both the flexible inner hose 130 and the flexible middle hose 140 is a flexible outer hose 150 serving to insulate the portions inside of it, including the flexible inner hose 130, flexible supply line 160 and flexible middle hose 140, from ambient temperatures. Each of the flexible inner hose 130, flexible middle hose 140 and flexible outer hose 150 is a hose, tube, or other type of transfer line of one or more of various known materials; one such material being stainless steel. A first annual region capable of evacuation 132 is formed between the inner wall of the flexible inner hose 130 and the outer wall of the flexible supply line 160, along their lengths. A second annular region capable of evacuation 152 is formed between the inner wall of the flexible outer hose 150 and the outer wall of the flexible middle hose 140, along their lengths. These vacuum-capable regions may be formed in each instance by, for example, the placement of a plurality of spacer members between the outer wall of the concentrically inner line and the inner wall of the concentrically outer line.

As described previously herein, each of the flexible supply line 160 and the flexible return line 140 is for the transfer of cryogenic fluid, such as, by non-limiting example, gaseous or liquid helium, nitrogen or other cryogen. In the exemplary embodiment shown in FIG. 2, MLI 120 is disposed on the outer wall of the flexible supply line 160 and on the outer wall of the flexible middle hose 140. This MLI serves to further insulate the supply flow of cryogenic fluid within the supply line 160 and the return flow of cryogenic fluid 142 within the flexible middle hose 140, thereby maintaining temperatures of the cryogenic fluid within the system at relatively low temperatures throughout operation of the system.

In the exemplary embodiment of FIG. 2 the first terminal end of the flexible interface comprises a connector for connecting the flexible interface 100 to a cryocooler 200 shown in a vacuum housing 210. The connector of the exemplary embodiment is constructed to be compatible with one or more existing cryocoolers with which the interface will be used. Alternatively, the connector may be specifically designed for connection to a cryocooler that, together with the interface, are portions of a complete system.

The exemplary system of FIG. 2 shows the flexible interface 100 connected to a cryostat with an open cycle auxiliary cooling circuit. In this embodiment the cryocooler 200 is housed in a sealed vacuum housing 210 and is cooled by a compressor 201, having a compressor supply line 202 and compressor return line 203 connected to the cryocooler 200. Cryogen is supplied to the cryocooler from a source, such as the helium bottle 204 shown. The rate of the cryogen supply to the cryocooler is regulated by operation of a pressure regulator 205. The cryogen supply passes from the source to the supply line 160 of the cryocooler via a cryogen supply output line 206. The cryocooler reduces the temperature of the cryogen as the cryogen passes through three heat exchangers 292, 220, 230, which may be of various known types, such as counterflow heat exchangers. As shown the cryogen passes first through counterflow heat exchanger #3 292 and then through heat exchanger #1 220, resulting in reduction in temperature of the cryogen to an intermediate temperature. The cryogen then passes through heat exchanger #2 230 where the cryogen temperature is further reduced to the minimum temperature achievable by the cryocooler. In a preferred embodiment, such minimum temperature achievable by the cryocooler is in the range 4-10K.

In some embodiments, such as the one shown in FIG. 2, the cryogen within the cryocooler 200 may pass through a second Joule-Thomson device 240 before transfer of the cryogen to the flexible interface 100. Employing this second Joule-Thomson device 240 permits expansion cooling of the cryogen and thereby reduces the upper end of the range of the intermediate temperature of the cryogen. Alternatively, the second Joule-Thomson device 240 may be used in place of the first Joule-Thomson device 170.

Continuing with the embodiment shown in FIG. 2, the cryogen in the supply line 160 is now transferred, through the flexible interface 100 to the remote cooling location. The second terminal end of the flexible interface 100 comprises a rigid Stinger member operational to be inserted into this remote cooling device or location.

The flow of cryogen then enters the flexible middle hose 140 and returns from the remote cooling location. This return flow 142 passes through the length of the flexible interface 100 and returns to the cryocooler 200. Within the cryocooler the return flow 142 passes through counterflow heat exchanger #3 292 where it provides the initial cooling to the supply flow described previously.

The return flow 142 exits the system via the exhaust member 208. In some embodiments, a vacuum pump 207 is employed to provide efficiency to the return flow of the system and draw the return flow 142 from the remote cooling location, through the steps described, and to the exhaust member.

The flexible interface 100 of the present invention in this and other possible configurations within the scope of this disclosure differs from and improves upon the prior art in its operation to insulate, by virtue of the placement of the annular, evacuated regions and use of MLI 120, the fluids of the flexible supply line 160 and the flexible return line 140. The present invention thereby eliminates or nearly eliminates counter-flow heat exchange between the fluids contained in the supply and return lines while in the flexible interface. Whereas devices of the prior art employ such counter-flow heat exchange for cooling of the fluid within the supply line, the present invention demonstrates that more efficient cooling may be achieved in a flexible, repositionable interface by elimination of this counter-flow heat exchange and, instead, cooling of the cryogen prior to the introduction into the interface, and further cooling by placement of a Joule-Thomson device 170 at the second terminal end of the flexible interface, prior to the rigid terminal portion of the interface, which is the point of insertion into the intended cooling location.

In the embodiments described, the cold flow, within the flexible supply line after exiting the cryocooler and entering the flexible interface connected thereto, passes through the flexible supply line 160 along the length of the flexible interface and rigid terminal Stinger portion of the interface. It then passes through a Joule-Thomson device 170 at or near the second terminal end of the interface. This Joule-Thomson device and the alternate, or optional, second Joule-Thomson device 240 may be an orifice, capillary tubing or any such arrangement, variations of which will be known to one of skill in the art. The cryogenic fluid undergoes expansion as it moves from an area of high pressure to an area of low pressure. This process causes an additional drop in temperature. This can result in the delivery either of cold gas or a mixture of cold gas and liquid to the low pressure area. This low pressure, low temperature flow achieves the transfer of the cold to the sample location and cools the sample, without the counter-flow heat exchange employed by systems of the prior art. Certain embodiments of systems in accordance with the present disclosure are capable by employment of such configuration of delivering temperatures of 2K or lower at the remote cooling location.

The return flow 142 of cooled cryogenic fluid then returns, through the flexible middle hose 140, to the cryocooler. Gaseous cryogen may be either re-circulated using a closed recirculation loop or exhausted to the atmosphere.

As previously described, certain alternative embodiments of the disclosed system may eliminate the use of a Joule-Thomson device within the cryocooler and may be arranged with the Joule-Thomson device at the first terminal end of the interface, at or near the point of the interface's connection to the cryocooler. Still additional alternative embodiments may forego the use of the Joule-Thomson device at the first terminal end of the flexible interface and instead require, or be compatible with a cryocooler to which the interface is connected, which cryocooler comprises the Joule-Thomson device at a point prior to connectivity of the interface. It will be understood that the described locations of the Joule-Thomson device—integral to the cryocooler, at or near the first terminal end of the interface, and at or near the second terminal end of the interface—may be used in combination. Those of skill in the art will understand that other Joule-Thomson device locations are also possible.

Figure 3:
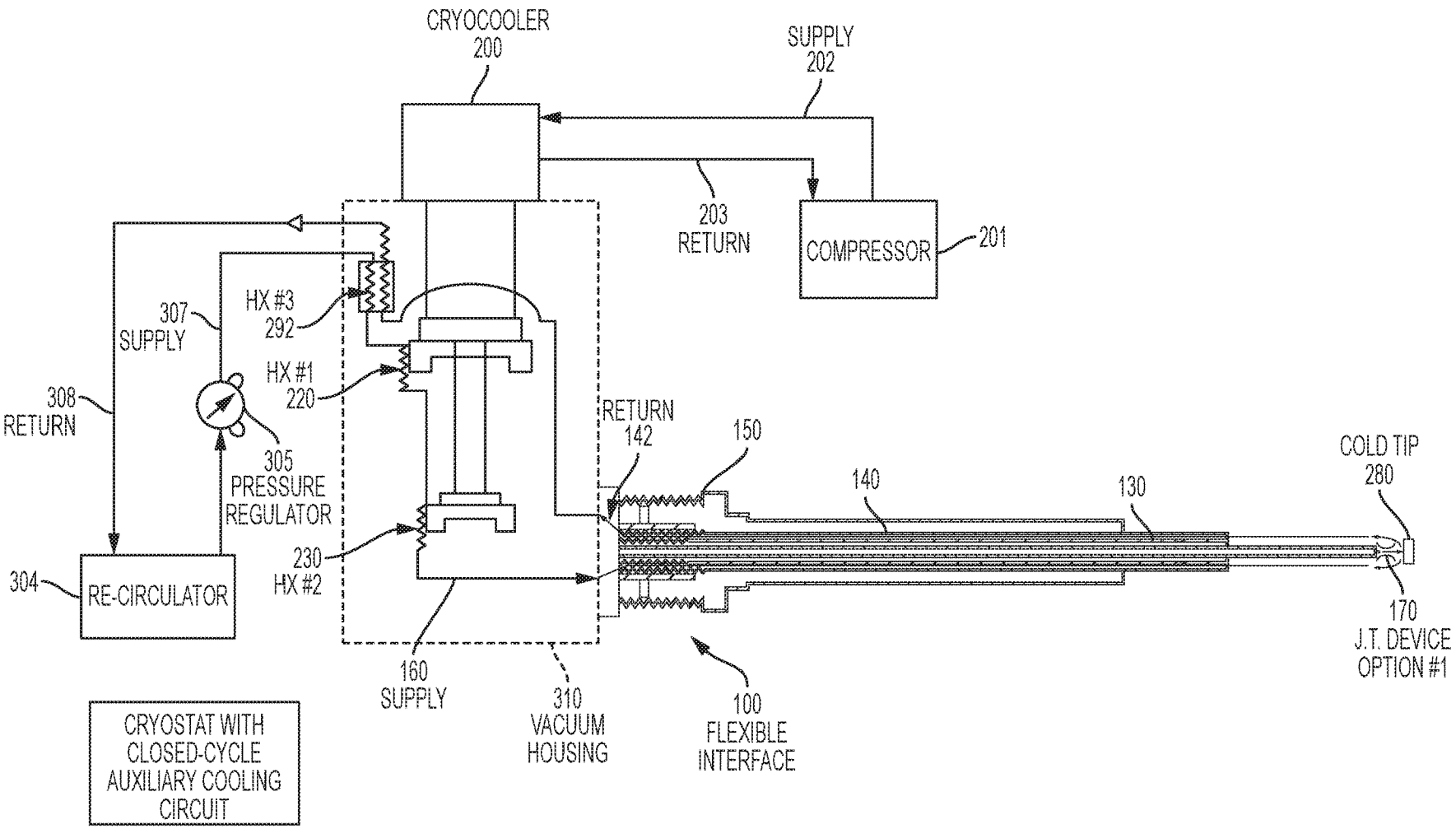
FIG. 3 is a block diagram showing the cryogenic cooling system with the flexible cold fluid discharge interface connected to a cryostat with a closed-cycle auxiliary cooling circuit.

In the cryocooler of the previous exemplary embodiment of FIG. 2, helium gas is supplied from a commercially available helium bottle 204. Referring now to FIG. 3, another exemplary embodiment is shown, wherein a closed loop helium re-circulator 304 is employed. The rate of flow of helium from the re-circulator 304 is controlled by operation of a pressure regulator 305 connected to the re-circulator. This flow of helium is delivered via the cryogen supply line 307 to the inlet port of the cryocooler and the flexible supply line 160. The cryogen then follows a similar path to that in the embodiment described with respect to FIG. 2, wherein the cryogen passes through heat exchanger #3 292, heat exchanger #1 220 and heat exchanger #2 230.

Within the cryocooler, the room temperature gas passes through counter-flow heat exchanger #3 292, which cools the gas from room temperature to an intermediate lower temperature by using the cooling power of the colder return gas. The pre-cooled gas then passes through heat exchanger #1 220, which is in direct thermal contact with the first stage of the cryocooler. The helium gas is cooled further on this stage closer to the first stage temperature of the cryocooler ranging from 30K to 100K. The gas then passes through heat exchanger #2 230, which is in direct thermal contact with the second stage of the cryocooler that is at the lowest temperature that the cryocooler can achieve. The gas is cooled to a temperature very close to the second stage of the cryocooler typically ranging from 4K to 25K. The cooled gas within the flexible supply line 160 is optionally routed through a Joule-Thomson device 240 within the housing of the cryocooler, then enters the flexible interface 100 and is delivered to the cold tip 280, as described above. The low pressure return flow 142 of cold gas then returns through the flexible interface 100. As shown and as previously described, a Joule-Thomson device 170 may be located proximate to the terminal end of the flexible interface and may provide expansion cooling prior to delivery of the cryogen to the remote cooling location.

The flow of cryogen at the cold tip then goes, via the return line, back into the gas return part of the helium circuit in the cryocooler section. There it provides cooling to the incoming room temperature high pressure helium in heat exchanger #3 292. In exemplary embodiments like that shown in FIG. 2, the returned gas then exits the system through the exhaust port.

As illustrated, the system of FIG. 3 employs a closed loop auxiliary circuit, wherein the return flow 142 is supplied via a re-circulator return line 308 to the re-circulator inlet port, which may again supply the returned cryogen to the cryocooler circuit.

The closed helium circuit of FIG. 3—as was illustrated with reference to the open circuit of FIG. 2—may also employ a vacuum pump on the exhaust side of the circuit. This permits the user to reduce the pressure on the exhaust side, and at the remote sample location. This results in even lower temperature at the sample, potentially below 3K, as opposed to operation without use of the vacuum pump wherein temperature of about 4.2K (liquid helium temperature at normal atmospheric pressure) has been achieved during tests. A further benefit of the use of such fully closed helium circuit is in permitting the user to employ existing cryocooling systems and to recirculate cooled helium, reducing the need for costly, external high purity helium gas or liquid helium supplies.

A distinct advantage of the flexible interface member of the system described herein is its ability to connect to existing systems, wherein a cryocooler, cold tip, or both may already be in place. Whereas no system of the prior art provides a closed cycle cryocooler integrated with a helium flow circuit and flexible interface that works with existing cryogenic systems, the present novel design allows researchers to run long-term experiments, simplify logistics of getting liquid helium dewars in a laboratory, simplifies operation of the system, automates the operation and reduces longer term operating costs by permitting connectivity of the interface to existing systems and more efficient cooling since the flexible interface may be repositioned between multiple sample locations without requiring that the system return to ambient temperature prior to repositioning the transfer interface.

The flexible interface member of the system described provides numerous operational advantages. The Stinger end of the flexible interface may include an integrated cold tip at the end of the Stinger. This integrated cold tip allows the gas to flow inside it after Joule-Thomson expansion, thereby cooling the cold tip. It also provides a path for the return flow 142 to get back into the return path of the flow circuit. In some embodiments the cold tip will have a radiation shield attached on the Stinger body to provide a cold shield to the sample to be cooled. The sample may be attached on the cold tip directly. This allows significant flexibility in the setting of remotely cooled cryogenic devices.

Novel operational advantage is also provided by use of the flexible interface in that the interface is not sensitive to the orientation of the cryogenic system. Therefore, the flexible interface advantageously does not depend on any specific orientation and may be used in conjunction with existing cryogenic systems, or complete systems of which the flexible interface is a portion, installed in any direction such as horizontal, cold tip up, cold tip down or at specific angle.

Additional features may be provided in certain embodiments of the present disclosure in order to reduce the introduction or transfer of contaminants through the system. Specifically, a cold trap may be employed between the outlet port of the pressure regulator 205, 305 and the supply line 160. Similar cold filtering or cold trapping members may be placed in connection with the supply line 160 after heat exchanger #2 230. This point of cold filtering is particularly advantageous in that the cryogen at this point is at its minimum temperature and impurities within the cryogen are most capable of filtering. Advantage is provided in the employment of either of these features in the reduction of contamination to the throttling device or devices within the system, thereby increasing the likelihood of maximum cooling by and optimal maintenance of pressure parameters within the system.

Figure 4:
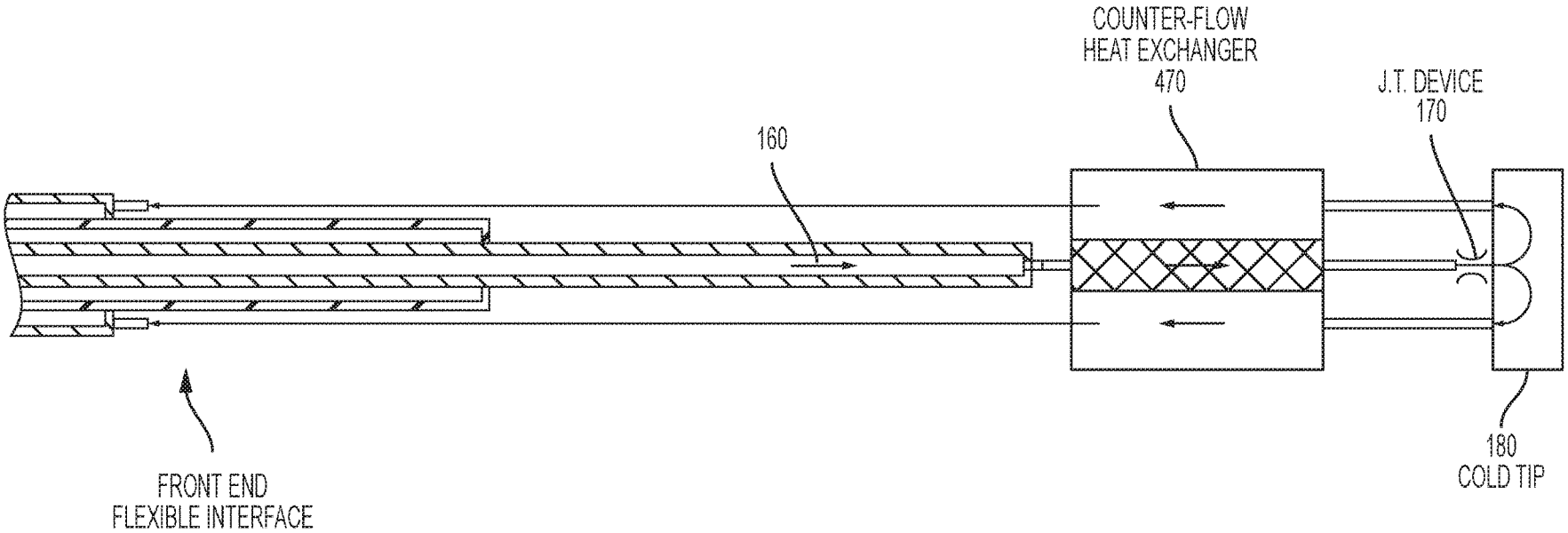
FIG. 4 is a side view of one embodiment of the flexible cold fluid discharge interface member with optional counter-flow heat exchanger.

FIG. 4 illustrates a further exemplary embodiment of the present invention. In this embodiment of the present invention, the return flow 142 of low pressure cold gas returns through a counter flow heat exchanger 470 which comprises a further element of the flexible interface. This provides the benefit of additional cooling to the incoming cryogen flow within the flexible supply line 160 and temperatures below 4K.

While various disclosed embodiments have been described above, it should be understood that they have been presented by way of example only, and not limitation. Numerous changes to the subject matter disclosed herein can be made in accordance with this Disclosure without departing from the spirit or scope of this disclosure. In addition, while a particular feature may have been disclosed with respect to only one of several implementations, such feature may be combined with one or more other features of the other implementations as may be desired and advantageous for any given or particular application.

We claim:

1. A system for cryogenic cooling of a remote cooling target, comprising:

a. a cryostat further comprising a cooling circuit that provides cooled helium gas;

b. a flexible cold fluid discharge interface receiving said cooled helium gas, said flexible cold fluid discharge interface including:

i. a flexible outer hose;

ii. a flexible middle recirculation line;

iii. a flexible inner hose;

iv. a flexible cryogen supply line;

v. a first annular vacuum insulating area disposed between said flexible outer hose and said flexible middle recirculation line, and a second annular vacuum insulating area disposed between said flexible inner hose and said said flexible cryogen supply line;

vi. said flexible outer hose, said first annular vacuum insulating area, said flexible recirculation line, said flexible inner hose, said second annular vacuum insulating area and said flexible cryogen supply line are arranged substantially concentrically;

vii. a first terminal end of the flexible cold fluid discharge interface connected to said cryostat; and viii. a rigid insertion member disposed at a second terminal end of the flexible cold fluid discharge interface for inserting into a remote cooling location;

c. wherein the system is capable of delivering cryogen of temperatures less than 30K at said remote cooling location.

2. The system of claim 1 wherein multi-layer insulating material is disposed on an outer wall of said flexible middle recirculation line and on an outer wall of said flexible cryogen supply line.

3. The system of claim 2 wherein said multi-layer insulating material has a reflective aluminized surface.

4. The system of claim 1 further comprising one or more throttling devices in thermal contact with said flexible cryogen supply line arranged to effectuate expansion cooling of cryogen.

5. The system of claim 1 further comprising a counter-flow heat exchanger disposed between said first terminal end and said second terminal end of the flexible cold fluid discharge interface.

6. The system of claim 1 wherein said cryostat comprises a closed cycle auxiliary cooling circuit including a recirculator that recirculates return helium gas from the flexible middle recirculation line to the flexible cryogen supply line.

7. The system of claim 6, wherein said cryostat includes an additional counter-flow heat exchanger to permit the system to achieve temperature output of 3K or lower.

8. The system of claim 6, wherein said cryostat further comprises a hermetically sealed, non-lubricated vacuum component using helium to achieve sub-cooling of a refrigerant to temperatures below 4K.

9. The system of claim 6, wherein said flexible middle recirculation line delivers cryogen to the recirculator at a pressure within the range of vacuum to 20 pounds per square inch.

10. The system of claim 6 wherein the recirculator delivers cryogen to said flexible cryogen supply line at a pressure within the range of 20 to 300 pounds per square inch.

11. The flexible cold fluid discharge interface of claim 1 wherein said cryostat comprises an open cycle auxiliary cooling circuit.

12. The system of claim 11, wherein said cryostat includes an additional counter-flow heat exchanger to permit the system to achieve temperature output of 3K or lower.

13. The system of claim 11, wherein said cryostat further comprises a hermetically sealed, non-lubricated vacuum component using helium to achieve sub-cooling of a refrigerant to temperatures below 4K.

14. The system of claim 11, wherein said flexible middle recirculation line delivers cryogen to an exhaust portion of the system at pressure within the range of vacuum to 20 pounds per square inch.

* * * * *